US011181126B2

(12) United States Patent
Karbassi

(10) Patent No.: US 11,181,126 B2
(45) Date of Patent: Nov. 23, 2021

(54) SYSTEMS AND METHODS FOR OPERATING A DIRECT CURRENT HYDRAULIC PUMP

(71) Applicant: Kar-Tech, Inc., Delafield, WI (US)

(72) Inventor: Hassan Karbassi, Delafield, WI (US)

(73) Assignee: Kar-Tech, Inc., Delafield, WI (US)

( * ) Notice: Subject to any disclaimer, the term of this patent is extended or adjusted under 35 U.S.C. 154(b) by 330 days.

(21) Appl. No.: 15/889,854

(22) Filed: Feb. 6, 2018

(65) Prior Publication Data

US 2019/0242411 A1 Aug. 8, 2019

(51) Int. Cl.

| | |
|---|---|
| ***F15B 11/04*** | (2006.01) |
| ***F15B 11/042*** | (2006.01) |
| ***F15B 13/044*** | (2006.01) |
| ***F15B 11/08*** | (2006.01) |

(52) U.S. Cl.

CPC ..... *F15B 11/0423* (2013.01); *F15B 11/08* (2013.01); *F15B 13/044* (2013.01)

(58) Field of Classification Search

CPC . B66C 13/20; B66C 13/22; F15B 2211/6346; F15B 11/0423; F15B 13/044; F15B 11/08

See application file for complete search history.

(56) References Cited

U.S. PATENT DOCUMENTS

| | | | | |
|---|---|---|---|---|
| 7,506,505 | B2 * | 3/2009 | Fushimi | B66F 9/20 60/368 |
| 8,587,228 | B2 | 11/2013 | Anderson | |
| 9,206,667 | B2 * | 12/2015 | Khvoshchev | E21B 34/16 |
| 9,447,563 | B2 * | 9/2016 | Ikegami | E02F 3/435 |
| 9,816,252 | B2 | 11/2017 | Hoshino et al. | |
| 2011/0192695 | A1 | 8/2011 | Lundstrom | |
| 2012/0132394 | A1 * | 5/2012 | Oberti | B60K 1/00 165/51 |
| 2016/0207420 | A1 | 7/2016 | Nilsson et al. | |
| 2017/0184092 | A1 | 6/2017 | Bublitz et al. | |
| 2018/0143625 | A1 * | 5/2018 | Nelson | G05B 19/042 |

* cited by examiner

*Primary Examiner* — Abiy Teka

(74) *Attorney, Agent, or Firm* — Smith Keane LLP

(57) ABSTRACT

System and methods for a DC powered hydraulic system capable of providing control over pressurized hydraulic fluid delivered to directional valves without the need for a PTO and/or a proportional valve. The hydraulic system controls the output from a battery to a direct current hydraulic pump.

18 Claims, 3 Drawing Sheets

SYSTEMS AND METHODS FOR OPERATING A DIRECT CURRENT HYDRAULIC PUMP

BACKGROUND OF THE INVENTION

Hydraulic systems for use in lifting or pushing systems (e.g., cranes, dump trucks, garbage trucks, snow plows, etc.), are typically systems in which a hydraulic pump is driven via a direct current (DC) power supply or a power take off (PTO) from a motor vehicle (e.g., a truck or tractor), to provide a constant, non-variable pressure at the output of the hydraulic fluid pump.

In an electrically driven system, pressurized hydraulic fluid from the hydraulic pump is provided directly to directional valves, wherein each directional valve controls the flow of pressurized hydraulic fluid to a hydraulic control cylinder (e.g., to control crane boom extension/retraction, boom rotation, boom up/down, etc.). When in operation, such system relies on electrical power, such as power from a vehicle battery or battery bank, to maintain pressure within the hydraulic pump at all times. This requirement, however, is not optimal because the pressure in the system is maintained even when there may be no demand to operate any of the hydraulic cylinders, thus draining the batteries prematurely and causing component (e.g., battery or solenoid switching) failure. Additionally, when a directional valve is operated, the valve opens and closes under the full load of the pressure provided by the pump, which increases wear on the system's parts as the hydraulic cylinders are activated and deactivated in an on/off or "bang-bang" manner.

In a mechanically driven mobile hydraulic pump system, the pressurized fluid from the hydraulic pump is provided first to a proportional valve and then to directional valves. Thus, because the output of the hydraulic pump is constant, the proportional valve is used to throttle the pressure prior to delivering hydraulic fluid to the directional valves. This decreases the wear on the system because it provides control of the pressurized hydraulic fluid, but it requires the installation of a PTO system.

Therefore, there is a need for a hydraulic system having enhanced modulation capable of providing control over pressurized hydraulic fluid delivered to directional valves without the need for a PTO and/or a proportional valve.

SUMMARY OF THE INVENTION

The present invention relates to a DC powered hydraulic system capable of providing control over pressurized hydraulic fluid delivered to directional valves without the need for a PTO and/or a proportional valve. The proposed system providing controllable hydraulic pump output to all directional valves through the operation of a DC motor driving a hydraulic pump.

One aspect of the present invention is to provide a controller for operating a hydraulic system with an axis of operation, a battery with a battery output, and a direct current (DC) hydraulic pump, wherein the controller comprises an axis switch in operative communication with the axis of operation in the hydraulic system; and a trigger switch configured to control the battery output to the DC hydraulic pump.

The hydraulic system may have a receiver and the controller may further comprise a transmitter configured to transmit the position of the axis switch and the position of the trigger switch to the receiver of the hydraulic system. The axis switch may be a two-way momentary switch, and the trigger switch may be a variable speed switch.

Another aspect of the present invention is to provide a hydraulic system comprising a machine with an axis of operation; a directional valve operatively connected to the axis of operation; a direct current (DC) hydraulic pump operatively connected to the directional valve; a controller; a battery with a battery output; and a command center in electrical communication with the hydraulic pump, the controller, and the battery; whereby the controller communicates with the command center, operation of the directional valve and the battery output to the hydraulic pump.

The controller may further comprise an axis switch and a trigger switch, both may be configured to be in communication with the command center, whereby operation of the axis switch corresponds to the operation of the directional valve and operation of the trigger switch corresponds to the battery output provided to the hydraulic pump.

Both the axis switch and the trigger switch may be required to be closed prior to the operation of the axis of operation. The axis switch may be a two-way momentary switch, and the trigger switch may be a variable-speed switch.

The battery output provided to the pump may be within a predetermined range and determined by the position of the trigger switch. The predetermined current output range may be customizable through a graphic user interface of an electronic device. A ramp-rate of battery output provided to the pump may be predetermined and the ramp-rate of battery output may be customizable through a graphic user interface of an electronic device.

The controller may communicate to the command center wirelessly.

Another aspect of the present invention includes a method of operating an axis of operation on a machine comprising the steps of providing a directional valve operatively connected to the axis of operation; providing a direct current (DC) hydraulic pump operatively connected to the directional valve; providing a battery with a battery output; activating the directional valve; delivering the battery output to the DC hydraulic pump, wherein the battery output is variable.

The method may further comprise the steps of providing a controller; providing a command center in electrical communication with the hydraulic pump, the controller, and the battery; delivering a command from the controller to the command center to activate the directional valve; and delivering a command from the controller to the command center to provide battery output to the DC hydraulic pump.

The controller according to the method may further comprise an axis switch and a trigger switch, both configured to be in communication with the command center, whereby operation of the axis switch corresponds to the operation of the directional valve and operation of the trigger switch corresponds to the battery output provided to the hydraulic pump.

Both the axis switch and the trigger switch may be required to be closed prior to the operation of the axis of operation. The axis switch may be a two-way momentary switch, and the trigger switch may be a variable-speed switch.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
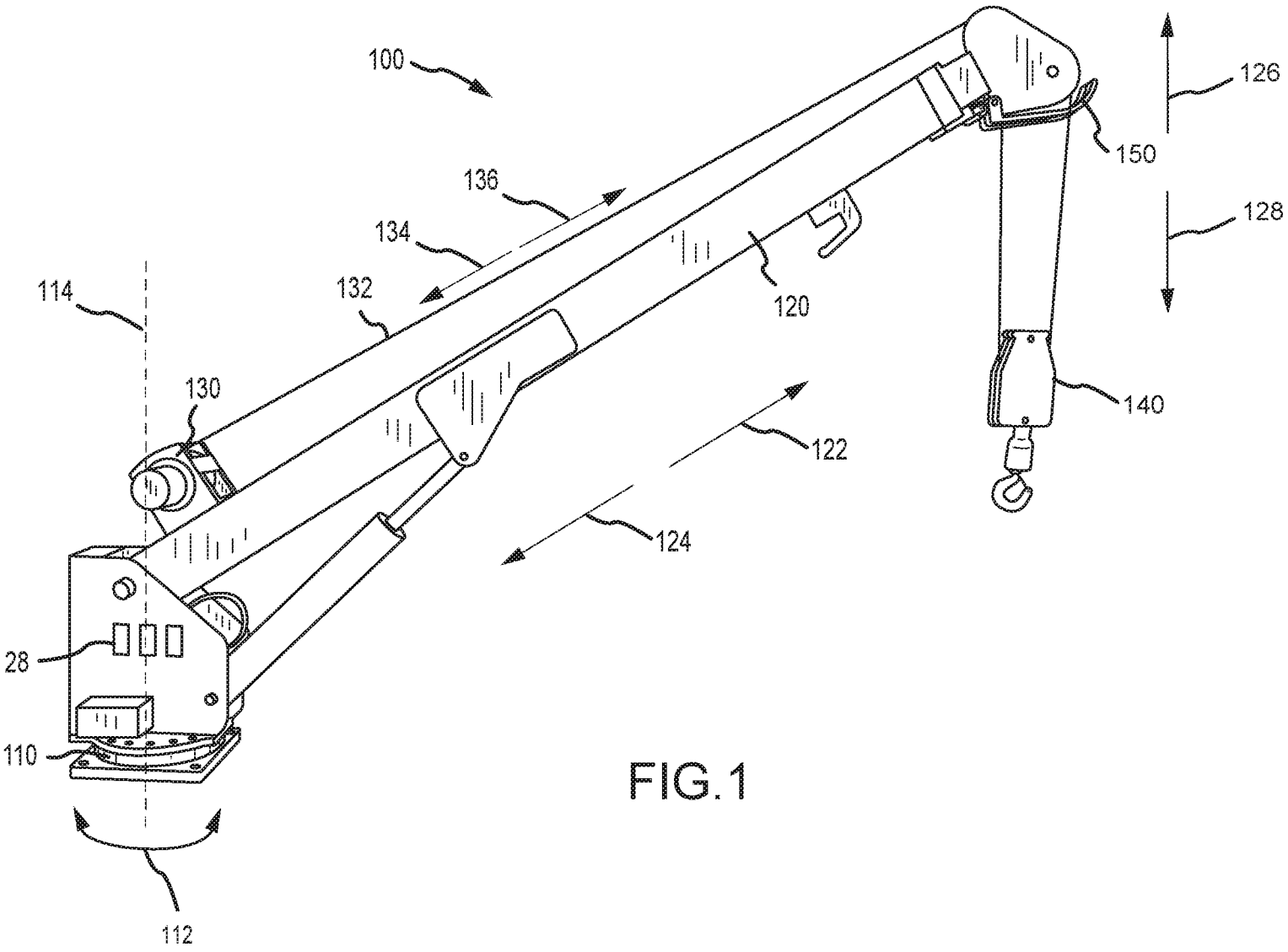
FIG. 1 is a side elevation view of a crane incorporating a hydraulic system according to the present invention.

FIG. 1 illustrates a mountable crane assembly 100 on which may be installed a hydraulic system 10 according to the present invention. In the example provided, the mountable crane assembly 100 may be mounted in the bed of a truck (not shown). It should be understood, however, that the discussion directed to the hydraulic system 10 with respect to the mountable crane assembly 100 is for illustrative purposes only, and that the hydraulic system 10 may be applied to various machines incorporating hydraulics, including, but not limited to, dump trucks, tractors, etc.

The crane assembly 100 comprises a slewing platform 110, a boom 120, and a winch 130 with winch cable 132. The slewing platform 110 allows the boom 120 to rotate 112 about a first axis 114, which may be a vertical axis relative to the ground; the boom 120 is configured to extend 122, retract 124, raise 126, and lower 128; and the winch cable 132 may be threaded through a gun tackle arrangement 140 and configured to be coupled to a payload (not shown) and raise and lower the payload relative to the crane assembly 100 by winding the winch cable 132 in 134 or letting the winch cable 132 out 136.

Figure 2:
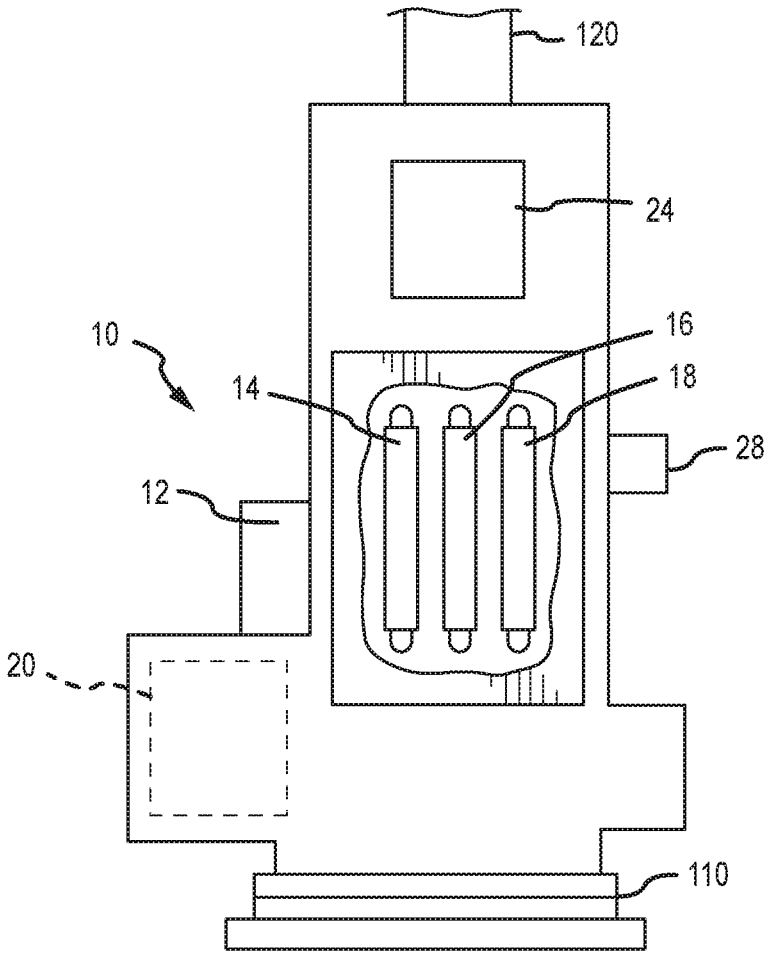
FIG. 2 is a side elevation view of the crane shown in FIG. 1.
Figure 3:
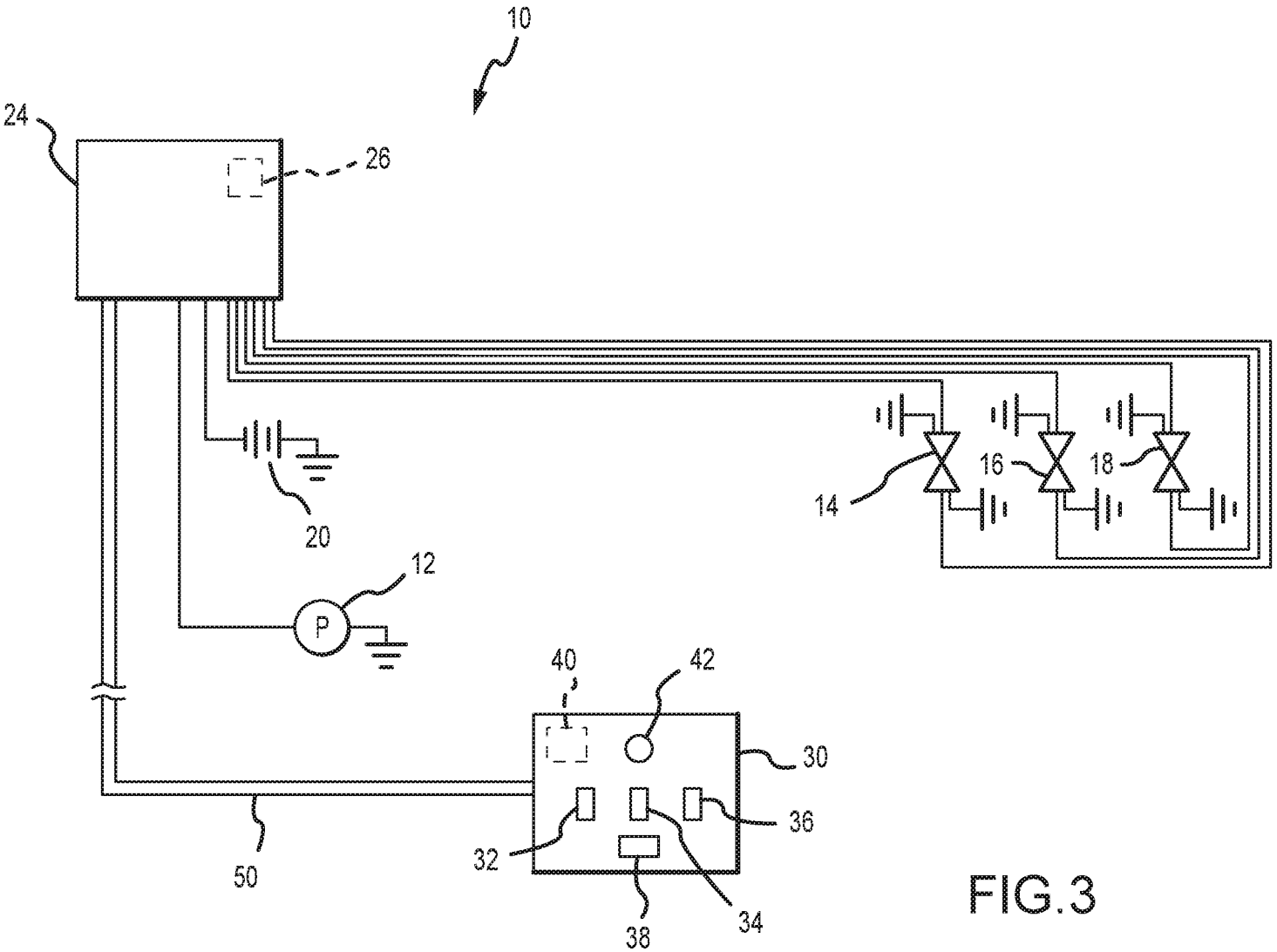
FIG. 3 is an electrical schematic of an embodiment of the hydraulic system according to the present invention.

FIGS. 2 and 3 illustrate an exemplary embodiment of the hydraulic system 10 according to the present invention. The hydraulic system 10 preferably comprises a pump 12; a plurality of directional valves (here shown as a first directional valve 14, a second directional valve 16, and a third directional valve 18); a battery 20; a command center 24; and a relay 28. Preferably, each of the directional valves 14,16,18 is an electronically controlled directional valve having a fluid input (hidden) received from the pump 12, and fluid output (hidden) to direct hydraulic fluid to hydraulic cylinders to control operation of an individual axis movement (e.g., boom extension, boom rotation, boom vertical movement, etc.). An example of a directional valve which can be used within the present invention is a 12-volt DC, four-port, three-position directional control valve produced by Argo Hytos.

As stated earlier, while a three-cylinder (or 3-axis) system is described herein, it should be noted that the hydraulic system 10 according to the present invention may be implemented on systems involving more or less than three directional valves, with a valve provided for each axis operation. It is also contemplated that proportional valves (not shown) may be used in place of, in combination with, or in addition to the directional valves 14,16,18.

The command center 24 is preferably in electrical communication with the pump 12; the first, second, and third directional valves 14, 16, 18; the battery 20; and the relay 28. The command center 24 preferably receives commands from a handheld controller 30 (FIG. 3), described below, and outputs the commands to the pump 12 and the first, second, and third directional valves 14, 16, 18. The pump 12 is preferably in fluid communication with the directional valves 14,16,18.

Additionally or alternatively, other elements may be incorporated into the hydraulic system 10 and in electrical communication with the command center 24. For example, a horn (not shown), pressure switches (not shown) and limit switches 150 to indicate the operational limits of the axes, and additional relays (not shown) for the activation of other elements such as a manual override (not shown).

FIG. 3 illustrates a simplified schematic of the electrical elements of the hydraulic system 10 shown in FIG. 2 and further illustrates the handheld controller 30. According to the exemplary embodiment of the present invention described herein, the handheld controller 30 preferably comprises a first axis switch 32, a second axis switch 34, and a third axis switch 36; a trigger switch 38 (preferably capable of modulating a control signal); a transmitter 40; and an emergency stop switch 42. The handheld controller 30 is preferably configured to communicate wirelessly with a receiver 26 preferably incorporated within the command center 24. The communication may be provided via any now known or later developed wireless communication technology (e.g., BLUETOOTH® communication, radio frequency signals, wireless local area network communication, infrared communication, near field communications (NFC), etc.). Additionally, or alternatively, a cable 50 may be used to provide passage of electrical communication between the handheld controller 30 and the command center 24.

Preferably, the first, second, and third axis switches 32, 34, 36 are two-way momentary switches, with each assigned to one of the directional valves 14, 16, 18. Each two-way momentary switch 32, 34, 36 has a first position which closes a first circuit, a second position which closes a second circuit, and a neutral position in which the first and second circuits remain open.

The trigger switch 38 is preferably a variable-speed switch (i.e., the voltage across the switch is dependent upon the switch position). Additionally or alternatively, the trigger switch 38 may be a joystick, a hall-effect pushbutton or any other device known to a person having ordinary skill in the art and which is capable of performing the function as stated. The handheld controller 30 is configured to transmit operational commands to the command center 24 to operate the various axes. In operation, it is preferable that both an axis switch 32, 34, 36 and the trigger 38 be engaged in order for the chosen operation to commence; however, this is not necessary.

According to the present invention, the command center 24 preferably receives an input (preferably an electrical signal) associated with the operation of an axis of a hydraulically controlled apparatus, and the command center 24 outputs a variable current to the hydraulic pump 10 based on the input received by the command center 24. It is also contemplated that the voltage to the hydraulic pump 10 may be varied, alone or in combination with a variable current, to increase or decrease the amount of hydraulic pressure produced by the hydraulic pump 10, within the acceptable operable characteristics of the hydraulic pump 10; however, the exemplary embodiment providing a variable current will be described herein for simplification.

The input received by the command center 24 preferably contains information directed to the axis to be operated and the amount of hydraulic pressure to be output from the hydraulic pump 10. The hydraulic pressure from the pump 10 is preferably directly related to the current output from the command center 24, which is dictated by the input received by the command center 24. In other words, variation in the input received by the command center 24 alters the current output by the command center 24 and the hydraulic pressure produced by the pump 10.

Additionally, or alternatively, the hydraulic system 10 is configured to be customizable. For example, the ramp rate (i.e., the rate at which the command center 24 changes current output from a first selected current output to a second selected current output after receiving input from the trigger switch 38), the minimum current output delivered to the pump 12 by the command center 24, and the maximum current output delivered to the pump 12 by the command center 24.

The ramping feature decreases the impact to the hydraulic and battery systems typically associated with the activation of directional valves. When a battery is outputting the optimal power output and engages the pump at 100% of that output, the result is sudden "bang" within the hydraulic system. Ramping reduces this impact because not all of the optimal power output is provided instantaneously, instead the power is gradually increased or decreased over a predetermined time period.

Additionally or alternatively, it is contemplated that the hydraulic system 10 is customizable as discussed herein through an application operable on an electronic device, such as a cellular phone, other personal electronic device, and/or a computer. The operational characteristics (e.g., minimum and maximum current output and ramp rate) may be viewed and modified through a graphic user interface provided on a display of the electronic device and communicated to the command center 24 via a wireless network or BLUETOOTH® communication, other wireless technology now known or later developed, and/or through a hard-wire connection.

An exemplary method of operating the extension 122 of the boom 120, according to the present invention is herein described. In this provided scenario, the first axis switch 32 is assigned to operate the first directional valve 14, which is operatively connected to the boom 120 and configured to extend 122 and retract 124 the boom 120 depending on the flow of the hydraulic fluid (not shown) through the first directional valve 14.

The first axis switch 32 is preferably a two-way momentary switch as stated above and therefore is configured to close a first circuit when maintained in the first position and to close a second circuit when maintained in the second position. The closing of the first circuit opens a pathway (not shown) in the first directional valve 14 to allow hydraulic fluid to pass through in a first direction to extend 122 the boom 120. The closing of the second circuit opens a pathway (not shown) in the first directional valve 14 to allow hydraulic fluid to pass through in a second direction to retract 124 the boom 120.

As provided above, the operation of any of the axes may be a two-part procedure requiring activation of at least one of the axis switches 32, 34, 36 and activation of the trigger switch 38 and an exemplary method of use follows, but it should be noted that the method may be performed through the operation of a single switch incorporating the features herein described. With that said, according to the exemplary embodiment shown herein, to extend the boom 120 the first axis switch 32 is retained in the first position, and with the first axis switch 32 retained in the first position, the trigger switch 38 is activated. The handheld controller 30 transmits to the command center 24 that the first axis switch 32 is in the first position and also transmits the position of the trigger switch 38. The command center 24 opens a pathway in the first directional valve 14 to allow hydraulic fluid (not shown) to flow in the direction required to extend 122 the boom 120. The command center 24 also outputs an amount of current to the hydraulic pump 12 in the proportion dictated by the position of the trigger switch 38. The hydraulic system 10 is preferably configured to supply current in a range from about 0% to about 100% of the available current capacity from the battery 20.

Continuing in the method example, when the second axis switch 34 is activated to simultaneously operate another axis (for example to raise 126 the boom 120) along with the extension 122 of the boom 120 activated by the first axis switch 32, the hydraulic pressure provided by the pump 12 is preferably divided substantially equally among the two axis operations. If, at the time of the activation of the second axis, the trigger switch 38 is maintained in the pre-second-axis-activation position, the speed of the first axis operation (extending 122 the boom 120) is halved because the command center 24 is outputting a predetermined amount of current to the pump 10 dependent upon the position of the trigger switch 38.

If the trigger switch 38 is not in a position in which the command center 24 is outputting 100% (or the preset maximum output) of the current capacity of the battery 20 to the pump 12 at the time of activating the second axis, the current to the pump 12 may be increased to increase the hydraulic pressure in the hydraulic system 10 by moving the trigger switch 38 in the direction corresponding to providing more current to the pump 12. For example, if the pre-second-axis-activation position of the trigger switch 38 is positioned to provide 50% of the potential output current to the pump 12 as directed by the command center 24, after the activation of the second axis, the trigger switch 38 may be re-positioned to provide more than 50%, for example 100%, of the current output to the pump 12 as directed by the command center 24. When 100% of the output current (i.e., double the original output current) is demanded, the hydraulic pressure is increased to each of the two operating axes. In this example, this means that the hydraulic pressure now provided to extend 122 the boom 120 (i.e., the speed of the extension operation 122), is the same as it was prior to the activation of the second axis operation.

Further, if the third axis switch 36 is also activated, the hydraulic pressure is preferably divided substantially equally among the three axis operations. The same hydraulic pressure distribution is preferably true for any additional activated axes.

The foregoing is considered as illustrative only of the principles of the invention. Furthermore, because numerous modifications and changes will readily occur to those skilled in the art, it is not desired to limit the invention to the exact construction and operation shown and described. While the preferred embodiment has been described, the details may be changed without departing from the invention, which is defined by the claims.

The invention claimed is:

1. A controller for operating a hydraulic system with an axis of operation, a battery with a battery output, and a direct current (DC) powered hydraulic pump, the controller comprising:

a two-way momentary axis switch having an axis switch position configured to be in operative communication with an on/off directional valve to activate and deactivate the axis of operation in the hydraulic system, the hydraulic system comprising a crane; and a variable speed trigger switch having a trigger switch position configured to modulate a battery control signal, the battery control signal varying at least one of electrical voltage and electrical current provided to drive the DC powered hydraulic pump, wherein hydraulic pressure from the DC powered hydraulic pump is directly related to the battery control signal, and wherein the controller is a handheld controller.

2. The controller according to claim 1, wherein the hydraulic system has a receiver and the controller further comprises a transmitter configured to transmit the axis switch position and the trigger switch position to the receiver of the hydraulic system.

3. A hydraulic system comprising:

a machine with an axis of operation, the machine comprising a crane;

an on/off directional valve operatively connected to activate and deactivate the axis of operation;

a direct current (DC) powered hydraulic pump operatively connected to the directional valve;

a handheld controller comprising a two-way momentary axis switch having an axis switch position and a variable speed trigger switch having a trigger switch position;

a battery with a battery output; and a command center in electrical communication with the hydraulic pump, the handheld controller, and the battery, whereby the handheld controller communicates the trigger switch position to the command center to modulate a battery control signal to vary at least one of electrical voltage and electrical current provided to the DC powered hydraulic pump and hydraulic pressure from the DC powered hydraulic pump is directly related to the battery control signal.

4. The hydraulic system of claim 3, wherein operation of the axis switch corresponds to operation of the directional valve and operation of the trigger switch corresponds to the battery output provided to the hydraulic pump.

5. The hydraulic system of claim 3, wherein both the axis switch and the trigger switch are closed prior to the operation of the axis of operation.

6. The hydraulic system of claim 3, wherein the axis switch is a two-way momentary switch.

7. The hydraulic system of claim 3, wherein the trigger switch is a variable-speed switch.

8. The hydraulic system of claim 7, wherein the battery output provided to the pump is within a predetermined range and determined by the trigger switch position.

9. The hydraulic system of claim 8, wherein the predetermined current output range is customizable through a graphic user interface of an electronic device.

10. The hydraulic system of claim 8, wherein a ramp-rate of battery output provided to the pump is predetermined.

11. They hydraulic system of claim 10, wherein the ramp-rate of battery output is customizable through a graphic user interface of an electronic device.

12. The hydraulic system of claim 3, wherein the handheld controller communicates to the command center wirelessly.

13. A method of operating an axis of operation on a machine, the method comprising the steps of:

providing an on/off directional valve operatively connected to activate and deactivate the axis of operation;

providing a direct current (DC) powered hydraulic pump operatively connected to the directional valve;

providing a battery with a battery output;

providing a handheld controller;

activating the directional valve;

delivering a signal comprising at least one of variable electrical voltage and electrical current modulated by the handheld controller to the DC powered hydraulic pump; and after activating the directional valve, varying the signal at a predetermined ramp rate to vary hydraulic pressure provided from the DC powered hydraulic pump to the directional valve.

14. The method of claim 13, further comprising the steps of:

providing a command center in electrical communication with the hydraulic pump, the handheld controller, and the battery;

delivering a command from the handheld controller to the command center to activate the directional valve; and delivering a command from the handheld controller to the command center to provide battery output to the DC powered hydraulic pump.

15. The method of claim 14, wherein the handheld controller further comprises an axis switch and a trigger switch, both configured to be in communication with the command center, whereby operation of the axis switch corresponds to the operation of the directional valve and operation of the trigger switch corresponds to the battery output provided to the DC powered hydraulic pump.

16. The method of claim 15, wherein both the axis switch and the trigger switch are closed prior to the operation of the axis of operation.

17. The method of claim 15, wherein the axis switch is a two-way momentary switch.

18. The method of claim 15, wherein the trigger switch is a variable-speed switch.

* * * * *